US008220532B2

(12) United States Patent
Hagen

(10) Patent No.: US 8,220,532 B2
(45) Date of Patent: Jul. 17, 2012

(54) MAGNET FIXING DEVICE IN A CLEANING TOOL

(75) Inventor: Karluf Hagen, Randaberg (NO)

(73) Assignee: M-I Swaco Norge AS, Stavanger (NO)

( * ) Notice: Subject to any disclaimer, the term of this patent is extended or adjusted under 35 U.S.C. 154(b) by 317 days.

(21) Appl. No.: 12/665,801

(22) PCT Filed: Jun. 25, 2008

(86) PCT No.: PCT/NO2008/000235

§ 371 (c)(1),
(2), (4) Date: Apr. 5, 2010

(87) PCT Pub. No.: WO2009/002185

PCT Pub. Date: Dec. 31, 2008

(65) Prior Publication Data

US 2010/0186945 A1 Jul. 29, 2010

(30) Foreign Application Priority Data

Jun. 26, 2007 (NO) ..... 20073272

(51) Int. Cl.
*E21B 37/00* (2006.01)
*E21B 31/06* (2006.01)

(52) U.S. Cl. ..... 166/66.5; 166/99

(58) Field of Classification Search ..... 166/66.5, 166/99, 311

See application file for complete search history.

(56) References Cited

U.S. PATENT DOCUMENTS

| | | | | |
|---|---|---|---|---|
| 2,778,669 | A * | 1/1957 | Goodwin | 166/66.5 |
| 2,830,663 | A * | 4/1958 | Kirby | 166/99 |
| 3,637,033 | A | 1/1972 | Mayall | |
| 4,113,611 | A | 9/1978 | Gohm | |
| 6,216,787 | B1 | 4/2001 | Ruttley | |
| 6,439,303 | B1 * | 8/2002 | Sorhus et al. | 166/99 |
| 6,491,117 | B2 * | 12/2002 | Ruttley | 175/328 |
| 6,629,562 | B1 * | 10/2003 | Fidan | 166/99 |
| 6,655,462 | B1 * | 12/2003 | Carmichael et al. | 166/311 |

(Continued)

FOREIGN PATENT DOCUMENTS

SU 1131999 12/1984

OTHER PUBLICATIONS

International Search Report issued by Swedish Patent Office for International Application No. PCT/NO2008/000235 filed Jun. 25, 2008.

(Continued)

*Primary Examiner* — Hoang Dang
(74) *Attorney, Agent, or Firm* — Sheridan Ross P.C.

(57) ABSTRACT

A magnet fixing device in a cleaning tool (1) for use in a borehole where the cleaning tool (1) is externally provided with at least one projection (8) and at least two recesses (6) and where at least one magnet (12) is disposed in the projection (8), as the magnetic field from the at least one magnet (12) is active in that it is arranged to at least attract a magnet sensitive material (20) into a recess (6) or hold the material (20) in the recess (6), and where the magnet (12) runs through the projection (8), whereby the one magnet (12) pole is active in a first recess (6) while the other magnet (12) pole is active in a second recess (6).

7 Claims, 3 Drawing Sheets

U.S. PATENT DOCUMENTS

| | | | | |
|---|---|---|---|---|
| 7,137,449 | B2 | 11/2006 | Silguero | |
| 7,219,724 | B2 * | 5/2007 | Theriot, Sr. | 166/66.5 |
| 7,735,547 | B2 * | 6/2010 | Telfer | 166/66.5 |
| 7,753,114 | B1 * | 7/2010 | Penisson | 166/99 |

OTHER PUBLICATIONS

Written Opinion issued by Swedish Patent Office for International Application No. PCT/NO2008/000235 filed Jun. 25, 2008.

* cited by examiner

I–I

MAGNET FIXING DEVICE IN A CLEANING TOOL

CROSS REFERENCE TO RELATED APPLICATIONS

This application is a national stage application under 35 U.S.C. 371 of PCT Application No. PCT/NO2008/000235 having an international filing date of 25 Jun. 2008, which designated the United States, which PCT application claimed the benefit of Norway Application No. 20073272 filed 26 Jun. 2007, the entire disclosure of each of which are hereby incorporated herein by reference.

This invention relates to a magnet fixing device in a cleaning tool. More particularly it concerns a magnet fixing device in a cleaning tool for use in a borehole. The cleaning tool is outwardly provided with at least one projection and at least two recesses wherein at least one magnet is provided in the projection, as the magnetic field from the at least one magnet is effective in that it is disposed for in the least to pull a magnet sensitive material into a recess or to hold the magnet sensitive material in the recess.

It is known to utilise magnets to bring magnet sensitive material out from a borehole in the earth. According to prior art, see for example U.S. Pat. No. 3,637,033, it is common to place a number of magnets about a pipe where the pipe forms a part of a pipe string.

Collected materials being attracted by the magnetic fields have a tendency to come into contact with the borehole wall and fall off during the further transport in the borehole.

Norwegian patent no. 314200 describes a magnet bracket, which is clamped around a pipe and where the pipe bracket is formed with a number of substantially longitudinal grooves with ridges between them. Magnets are provided in the ridges and the magnet forces from the magnets pulls magnet sensitive material into the grooves where the collected material is not so exposed to being scraped off. According to NO 314200 the magnets are utilised relatively inefficiently, as only one of the magnet poles is effective.

The object of the invention is to remedy or reduce at least one of the prior art drawbacks.

The object is achieved by features stated in the description below and in the following claims.

According to the invention there is provided a magnetic fixing device in a cleaning tool for use in a borehole, the cleaning tool being provided outwardly with at least one projection and at least two recesses, at least one magnet being provided in the projection, and the magnetic field from the at least one magnet being effective by being disposed for at least to pull a magnet sensitive material into a recess or to hold the magnet sensitive material in the recess. The magnet fixing device is characterised in that it runs wholly or partly through the projection, whereby the one magnet pole is effective in a first recess while the other magnet pole is effective in a second recess.

The projection typically comprises a through bore, which advantageously may be provided with a shoulder for positioning of magnets in the boring.

The through bore may be tangential relative to the cross-section of the cleaning tool. The bore may alternatively be inclined to make drilling tool access possible.

The recesses may advantageously be formed as axial or helical grooves where the projection is made up of a ridge between the grooves. The tool may comprise a number of grooves and ridges, which together encircle the cleaning tool.

If the borings are inclined then the borings that are distributed along the projection may advantageously be drilled alternatingly from the two sides of the projection. It may be appropriate to arrange opposing magnets with equal polarity facing each other.

It is further advantageous that at least one of the ridges in the cleaning tool is not provided with magnets, as the collected material present in the recesses otherwise to an unwanted degree would possibly choke a fluid flow between the cleaning tool and the borehole wall.

The cleaning tool is preferably made up of a tubular portion of a pipe string, but the magnet fixing device is also suitable for use in for example a bracket as shown in NO 314200.

The invention provides a magnet fixing device making an efficient use of each single magnet in the cleaning tool possible.

In the following is described an example of a preferred embodiment which is illustrated in the enclosed drawings, where:

Figure 1:
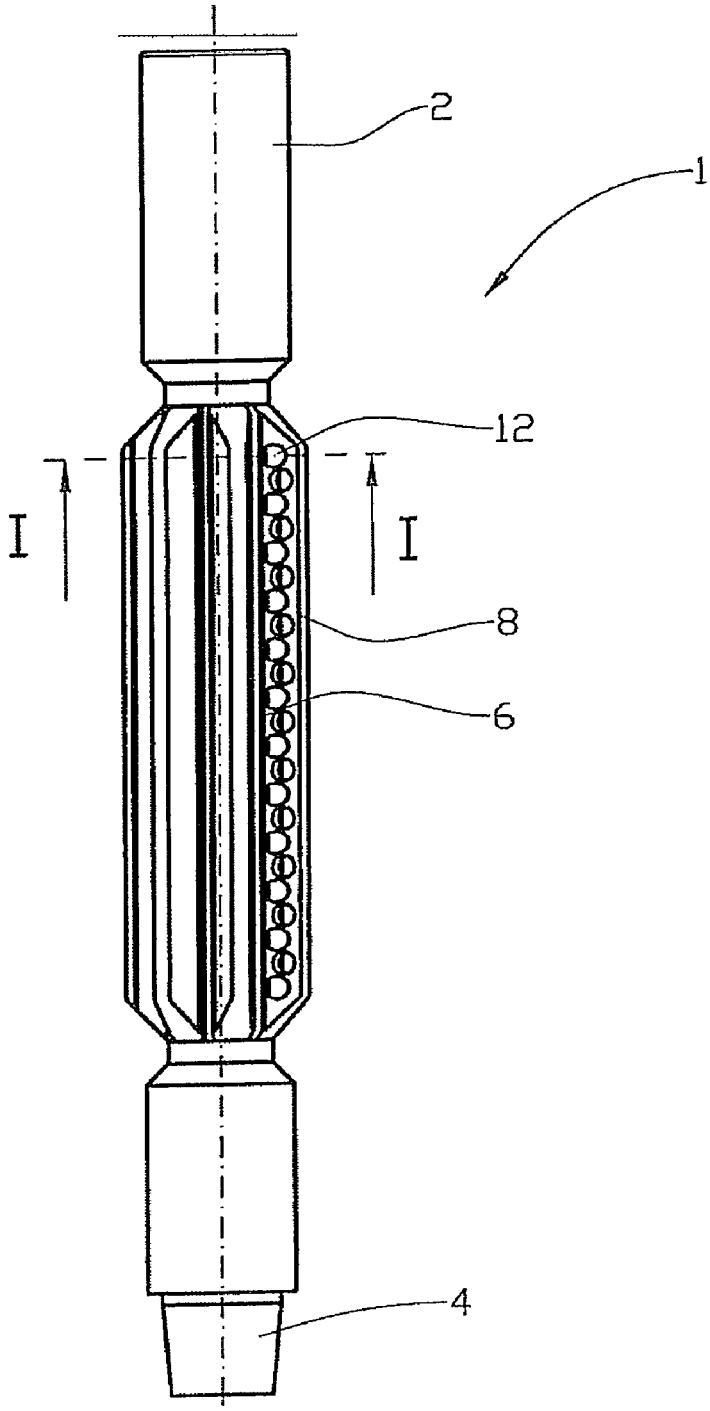
FIG. 1 shows a cleaning tool with a magnet fixing device according to the invention.

In the drawings the reference numeral 1 indicates a cleaning tool arranged to form a part of a pipe string (not shown) and therefore provided with, in its opposing ends, an internally threaded socket 2 and an externally threaded pin 4, respectively.

At its middle portion the cleaning tool 1 is provided with a number of longitudinal recesses 6 and projections 8 in the form of ridges therebetween. The recesses 6 and the projections 8 are spaced around the cleaning tool 1.

Figure 2:
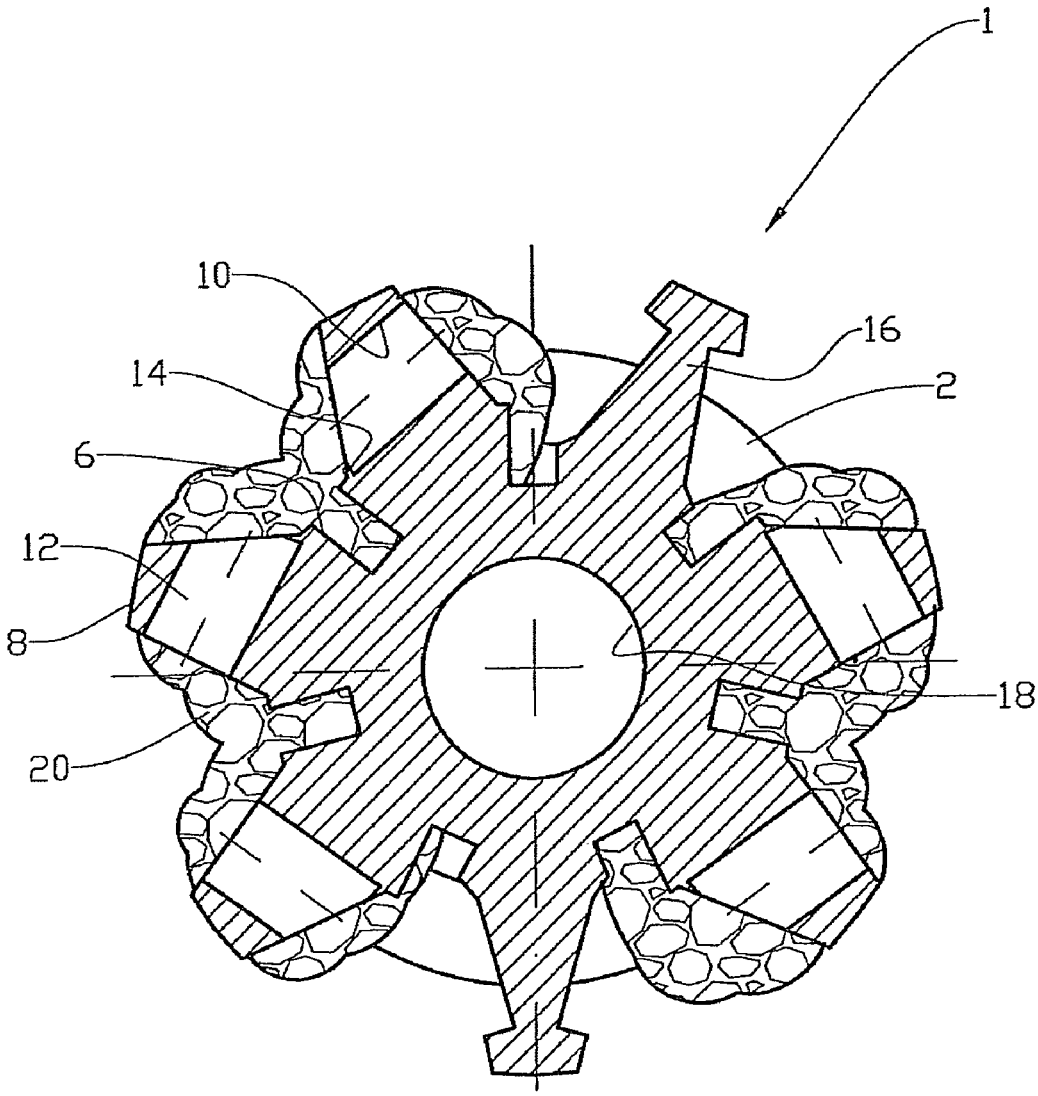
FIG. 2 shows in somewhat greater detail a cross-section I-I in FIG. 1.

Each projection 8 is provided with a number of through bores 10, see FIG. 2, wherein magnets 12 are placed. A shoulder 14 in the bore 10 makes a relatively simple positioning of the magnet 12 in the bore 12 possible. A magnet 12 is fixed in the bore 10 in a way known per se, e.g. by means of glue or by deforming the material encircling the bore 10.

The cleaning tool 1 is provided with magnet free projections 16 to ensure fluid flow therethrough as explained in the general part of the application. A centric through opening 18 runs through the cleaning tool 1.

When the cleaning tool 1 is displaced in a borehole (not shown), the magnetic field of the magnets 12 will attract magnet field sensitive material 20, see FIG. 2. The magnet field sensitive material 20 will build up at the magnets 12 and in the recesses 6.

Those recesses 6 that are adjacent the magnet free projections 16 are only partly filled with magnet sensitive material 20 as shown in FIG. 2.

Figure 3:
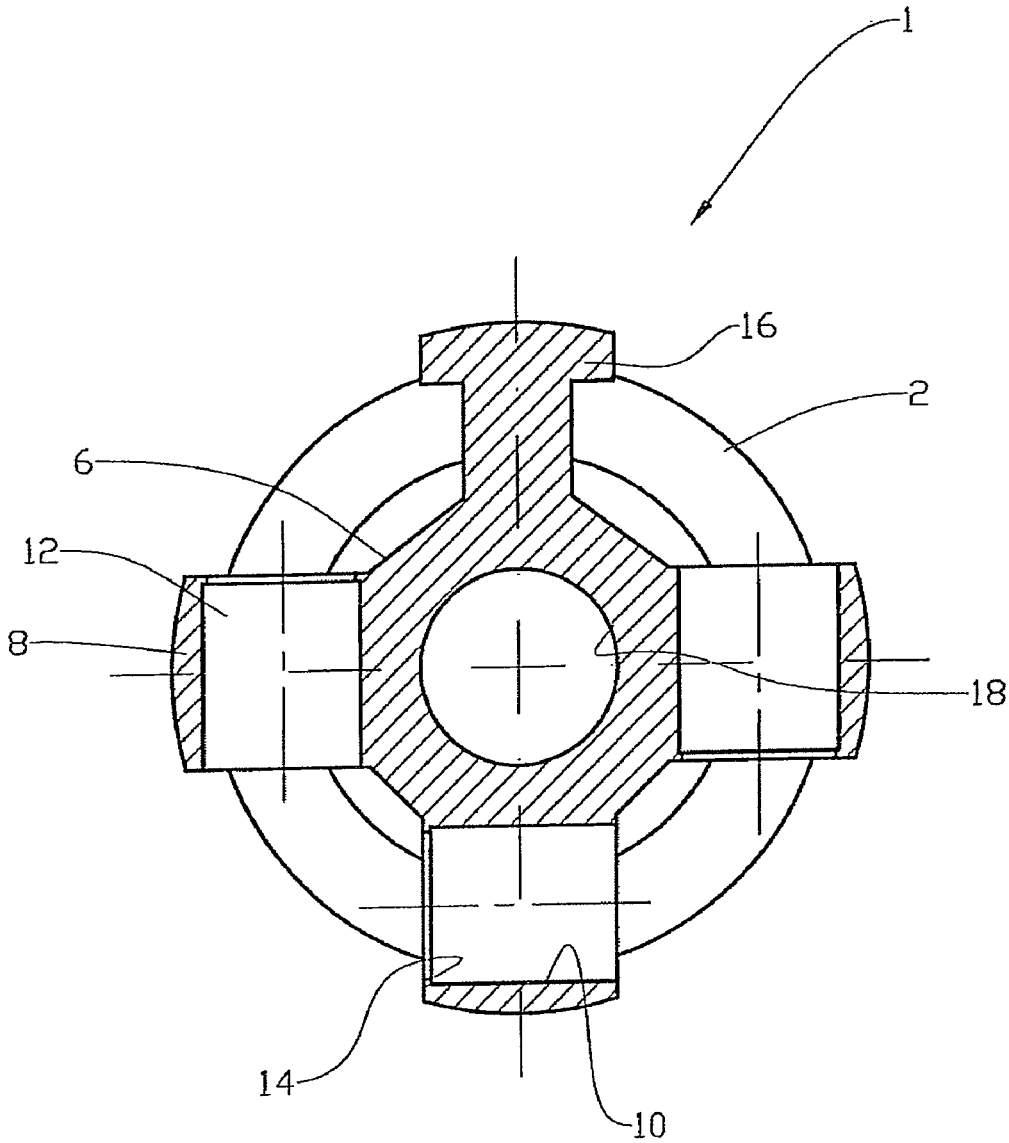
FIG. 3 shows a cross-section of a cleaning tool according to an alternative embodiment.

FIG. 3 shows a somewhat simplified cleaning tool 1 in cross-section.

The invention claimed is:

1. A magnet fixing device in a cleaning tool for use in a borehole wherein the cleaning tool is externally provided with at least one projection and at least two recesses and where at least one magnet is disposed in the projection, as the magnetic field from the at least one magnet is active being arranged to at least attract a magnet sensitive material into a recess or hold the material in the recess, characterised in that the magnet runs completely or partly through the projection, whereby the one magnet pole is active in a first recess while the other magnet pole is active in a second recess.

2. The device according to claim 1, wherein the projection comprises a through bore.

3. The device according to claim 2, wherein the bore is provided with a shoulder for positioning of the magnet in the bore.

4. The device according to claim 2, wherein the bore is tangential relative to the cleaning tool cross-section.

5. The device according to claim 2, wherein the bore is inclined relative to the cleaning tool cross-section.

6. The device according to claim 5, wherein the bores along the projection, if they are inclined, are drilled alternatingly from the two sides of the projection.

7. The device according to claim 1, wherein at least one of the cleaning tool projections is magnet free.

* * * * *

UNITED STATES PATENT AND TRADEMARK OFFICE

CERTIFICATE OF CORRECTION

PATENT NO. : 8,220,532 B2
APPLICATION NO. : 12/665801
DATED : July 17, 2012
INVENTOR(S) : Karluf Hagen It is certified that error appears in the above-identified patent and that said Letters Patent is hereby corrected as shown below:

On the cover page, at Assignee (73), please replace "M-I Swaco Norge AS, Stavanger (NO)" with --Schlumberger Norge AS, Tananger, (NO)--.

Signed and Sealed this
Twenty-second Day of January, 2013

David J. Kappos

David J. Kappos
*Director of the United States Patent and Trademark Office*